US011679317B2

(12) United States Patent
Martina

(10) Patent No.: US 11,679,317 B2
(45) Date of Patent: Jun. 20, 2023

(54) PITCHER TRAINING DEVICE

(71) Applicant: David Martina, Parma Heights, OH (US)

(72) Inventor: David Martina, Parma Heights, OH (US)

( * ) Notice: Subject to any disclaimer, the term of this patent is extended or adjusted under 35 U.S.C. 154(b) by 0 days.

(21) Appl. No.: 16/876,018

(22) Filed: May 16, 2020

(65) Prior Publication Data

US 2020/0360785 A1 Nov. 19, 2020

Related U.S. Application Data

(60) Provisional application No. 62/849,449, filed on May 17, 2019.

(51) Int. Cl.
*A63B 69/00* (2006.01)

(52) U.S. Cl.
CPC .. *A63B 69/0002* (2013.01); *A63B 2069/0006* (2013.01)

(58) Field of Classification Search
CPC ..... A63B 69/0002; A63B 2069/0006
USPC ..... 473/422, 454
See application file for complete search history.

(56) References Cited

U.S. PATENT DOCUMENTS 687,873 A * 12/1901 Daniels ..... F41J 7/04 273/390
2,578,313 A * 12/1951 Moseley ..... A63B 69/0091 473/426
2,890,052 A * 6/1959 Burrell ..... A63B 24/0021 273/375
3,118,670 A * 1/1964 Smith ..... A63B 69/0091 473/429
3,554,550 A * 1/1971 Schram ..... A63B 67/06 273/392
4,417,730 A * 11/1983 Weiner ..... A63B 69/0091 473/426
4,460,172 A * 7/1984 Hogan ..... A63B 69/0091 473/426
4,616,827 A 10/1986 Bergland
4,930,773 A 6/1990 Outlaw
5,222,732 A * 6/1993 Robey ..... A63B 69/38 473/459
5,472,187 A 12/1995 Kempf
5,728,031 A * 3/1998 Honeycutt ..... A61H 23/06 482/148
5,820,495 A 10/1998 Howland
5,984,813 A 11/1999 Cinnella
6,663,519 B2 12/2003 Kuhn et al.
7,217,202 B2 * 5/2007 Troxell ..... A63B 69/0002 473/422
7,247,106 B1 7/2007 Brandt
7,435,195 B1 * 10/2008 Calderon ..... A63B 69/0075 473/459
7,517,290 B1 * 4/2009 Springer ..... A63B 69/0002 473/422
7,753,811 B2 7/2010 Mark
(Continued)

*Primary Examiner* — Mitra Aryanpour
(74) *Attorney, Agent, or Firm* — Dominic A. Frisina; Buckingham Doolittle & Burroughs LLC

(57) ABSTRACT

A pitcher training device includes a vertically mountable base with certain integrated training elements. The training elements include a rotatable disc with an axis of rotation in a fixed angular orientation relative to the vertically mountable base. The rotatable disc is rotatably mounted to the vertically mountable base.

5 Claims, 3 Drawing Sheets

(56) References Cited

U.S. PATENT DOCUMENTS

| | | | | |
|---|---|---|---|---|
| 8,246,497 | B1 | 8/2012 | Garcia | |
| 8,333,671 | B1 * | 12/2012 | Wheel | A63B 71/023 473/422 |
| 8,439,774 | B2 | 5/2013 | Massey | |
| 8,708,843 | B1 | 4/2014 | Sekac et al. | |
| 8,807,570 | B1 * | 8/2014 | Zalar | F41J 7/04 273/390 |
| 9,149,698 | B2 | 10/2015 | Spiegler | |
| 9,308,427 | B2 * | 4/2016 | Garner | A63B 69/0071 473/422 |
| 9,623,312 | B2 * | 4/2017 | Hofmeyr | A63B 69/38 473/461 |
| 9,833,676 | B2 | 12/2017 | Smith, Jr. | |
| 2004/0077436 | A1 | 4/2004 | Goucher et al. | |
| 2006/0199673 | A1 | 9/2006 | Littlejohn | |
| 2014/0135151 | A1 | 5/2014 | Johnston | |

* cited by examiner

PITCHER TRAINING DEVICE

This application incorporates by reference in its entirety U.S. Provisional Patent Application No. 62/849,449.

I. BACKGROUND OF THE INVENTION

A. Field of Invention

The invention generally relates to the field of baseball pitcher training devices.

B. Description of the Related Art

Pitcher training devices have been around nearly as long as the sport of baseball itself. Each pitch requires the athlete to develop a specific muscle memory that can only be obtained through repetitive practice. Pitcher training devices are known in a general sense, but all have certain shortcomings. What is missing from the art is a device that can be easily installed in a dugout during practice and games to allow pitchers to practice muscle memory exercises when they would otherwise be idle, and which can be easily removed afterward along with the rest of the team's gear.

Some embodiments of the present invention may provide one or more benefits or advantages over the prior art.

II. SUMMARY OF THE INVENTION

Some embodiments may relate to a pitcher training device that provides for training the fastball and changeup pitches in a simple device that can be easily installed in a dugout. A player may use the device between innings for example, or even as a primary exercise, to develop and refine his muscle memory for throwing difficult pitches. Further, the device may be taken home after the game.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof, wherein like reference numerals indicate like structure, and wherein.

IV. DETAILED DESCRIPTION OF THE INVENTION

As used herein the terms "embodiment", "embodiments", "some embodiments", "other embodiments" and so on are not exclusive of one another. Except where there is an explicit statement to the contrary, all descriptions of the features and elements of the various embodiments disclosed herein may be combined in all operable combinations thereof.

Language used herein to describe process steps may include words such as "then" which suggest an order of operations; however, one skilled in the art will appreciate that the use of such terms is often a matter of convenience and does not necessarily limit the process being described to a particular order of steps.

Conjunctions and combinations of conjunctions (e.g. "and/or") are used herein when reciting elements and characteristics of embodiments; however, unless specifically stated to the contrary or required by context, "and", "or" and "and/or" are interchangeable and do not necessarily require every element of a list or only one element of a list to the exclusion of others.

Terms of degree, terms of approximation, and/or subjective terms may be used herein to describe certain features or elements of the invention. In each case sufficient disclosure is provided to inform the person having ordinary skill in the art in accordance with the written description requirement and the definiteness requirement of 35 U.S.C. 112.

Figure 1:
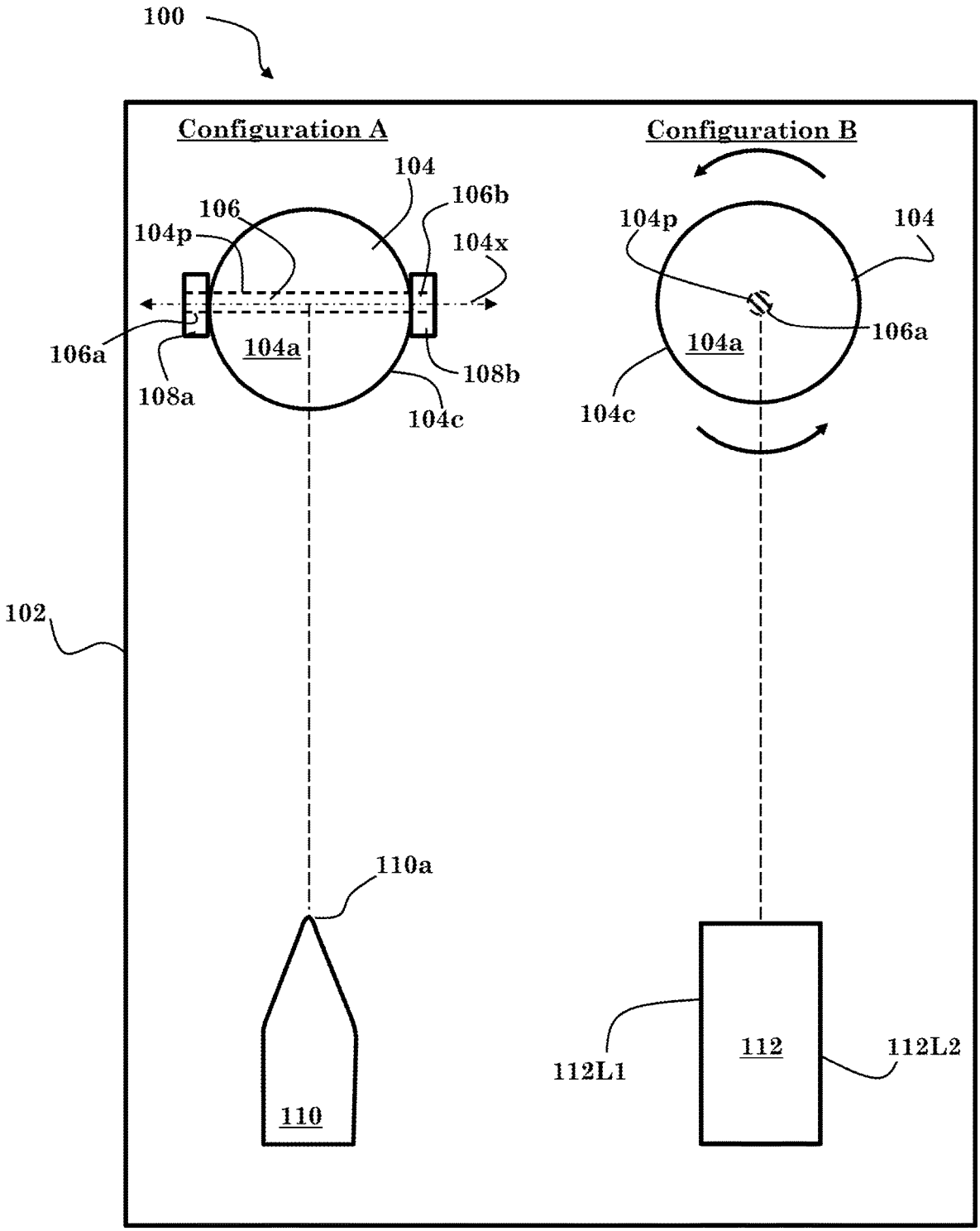
FIG. 1 is a front view of embodiment 100.

Referring now to the drawings wherein the showings are for purposes of illustrating embodiments of the invention only and not for purposes of limiting the same, FIG. 1 is a front view of embodiment 100. A vertically mountable base 102 is shown having certain components mounted on its surface. Particularly, two rotatable discs 104 are shown in two different rotatable mounting configurations, Configuration A and Configuration B. In both Configuration A and Configuration B, the rotatable disc 104 has a first circular face 104*a* and an opposing parallel second circular face 104*b* (out of view). Also in both configurations, the rotatable disc 104 has a circumferential surface 104*c* between the first and second circular faces 104*a*, 104*b*. The rotatable disc 104 may be solid or hollow as a matter of design choice. Without intending to limit the rotatable disc to any particular structure, one suitable component from which to fabricate a rotatable disc is a hockey puck.

The difference between Configuration A and Configuration B is in how the rotatable disc 104 is rotatably mounted to the vertically mountable surface 102. In Configuration A, a centrally located axis of rotation 104*x* extends through a diameter of the rotatable disc 104 in parallel alignment with a central aperture 104*p*. The person having ordinary skill in the art will understand that the centrally located axis of rotation 104*x* is a logical mathematical abstraction and not a physical component of the embodiment 100. Further, as used here and throughout the specification and claims, the term "central" or "centrally located" refers to a center of mass. Accordingly, the centrally located axis of rotation 104*x* passes through a center of mass of the rotatable disc, bisecting the rotatable disc 104 into equal halves. Moreover, the centrally located axis of rotation 104*x* does not change or move relative to the vertically mountable base 102, meaning the axis of rotation 104*x* is in a fixed angular orientation relative to the base 102.

In embodiments having a solid rotatable disc 104, the central aperture 104*p* comprises a single through-hole starting at a central opening in the circumferential surface 104*c*, passing through the disc, and ending in a second diametrically opposed central opening in the circumferential surface. In contrast, in embodiments having a hollow rotatable disc, the term "central aperture" means a pair of diametrically opposed openings in the circumferential surface 104*c*. In either case the central aperture 104*p* receives an axle 106 therethrough, about which the rotatable disc is free to rotate.

The axle 106 fixedly cooperates with the vertically mountable surface 102, meaning the axle 106 remains stationary relative to the vertically mountable surface 102, through a direct or indirect mechanical communication, while leaving the rotatable disc 104 free to rotate about the axle 106. The axle may directly connect to the vertically mountable surface 102 or it may connect to it through one or more intervening structures. In Configuration A of the embodiment 100, such an intervening structure is shown as circumferential mounting brackets 108*a*, and 108*b*. The first bracket 108*a* receives a first end 106*a* of the axle 106 in a fixedly mounted relation according to any suitable known means as the ordinarily skilled artisan is capable of selecting as a matter of design choice and without undue experimentation.

For example, and without limitation, the first bracket 108*a* may receive the first end 106*a* of the axle 106 in an interference fit, thus holding the axle 106 stationary relative to itself 108*a*. Alternatively, any of a wide variety of known means may be used such as, without limitation, cotter pins, press fitted end caps, threaded nuts, or one or more ends 106*a*, 106*b* of the axle 106 may be formed to a polygonal or star shape fitted to a complementary opening in the brackets 108*a*, 108*b* or, for instance, in a bushing fitted in the brackets 108*a*, 108*b*. The person having ordinary skill in the art will readily appreciate that only one end of the axle 106 must be fixedly mounted to a circumferential mounting bracket 108*a* or 108*b*. The other end of the axle may or may not be fixedly mounted while still achieving the same result, namely, to hold the axle 106 stationary while the rotatable disc 104 rotates about the axle 106. Thus, one end (106*a* or 106*b*) of the axle 106 may be mounted to the vertically mountable base 102 without being fixedly mounted, provided that the other end is fixedly mounted to the vertically mountable base 102.

The circumferential mounting brackets 108*a*, 108*b* may take any suitable form provided they fixedly mount to the axle 106 at one end and to the vertically mountable surface 102 at an opposing end. As used here, the term "fixedly mount" includes mounting directly or indirectly, and also includes mounting brackets 108*a*, 108*b* that are unitary with the vertical mounting surface 102, such as by comprising a single molded part. One important limitation of the circumferential mounting brackets 108*a*, 108*b* is that they must provide sufficient clearance between the rotatable disc 104 and the vertically mountable surface 102 to allow the rotatable disc 104 to rotate a full 360 degrees about the axle 106.

With continuing reference to Configuration A of FIG. 1, a follow-through landing wedge 110 is positioned below the rotatable disc 104 on the vertically mountable base 102. The landing wedge 110 includes a landing apex 110*a*. Similar to other components taught herein, the landing wedge 110 may be mounted to the vertically mountable base 102, directly or indirectly, or it may be unitary with the base 102, for example, by comprising a single molded part.

Configuration A, is particularly suitable for training a pitch where the pitcher provides backspin to the baseball, as in a fastball. The pitcher uses Configuration A by placing his fingers on the top edge of the circumferential surface 104*c* of the rotatable disc 104 and spinning the top edge toward himself. Proper follow-through is trained by requiring the pitcher to land his hand on the landing wedge 110 such that his hand finishes with the landing apex 110*a* between his second and third fingers, i.e. his middle finger and ring finger.

Configuration B, is suited for training the changeup pitch. The pitcher places his fingers at the top edge of the circumferential surface 104*c* and spins the rotatable disc 104 by moving his hand into a thumbs down position. Proper follow-through is trained by requiring the pitcher to land his hand on a vertical surface (112L1 or 112L2) of the follow-through landing 112.

With continuing regard to Configuration B of FIG. 1, the rotatable disc 104 is shown rotatably mounted to the vertically mountable base 102 through a central aperture 104*p* in a first circular face 104*a*. An end 106*a* of an axle 106 is shown. The other end 106*b* is out of view, but is fixedly mounted to the vertically mountable base 102 either directly or indirectly through one or more intervening structures. As in Configuration A, the rotational axis (not shown) coinciding with the axle does not move or change relative to the vertically mountable surface 102, thus the axis is in a fixed angular orientation relative to the vertically mountable surface 102.

Figure 2:
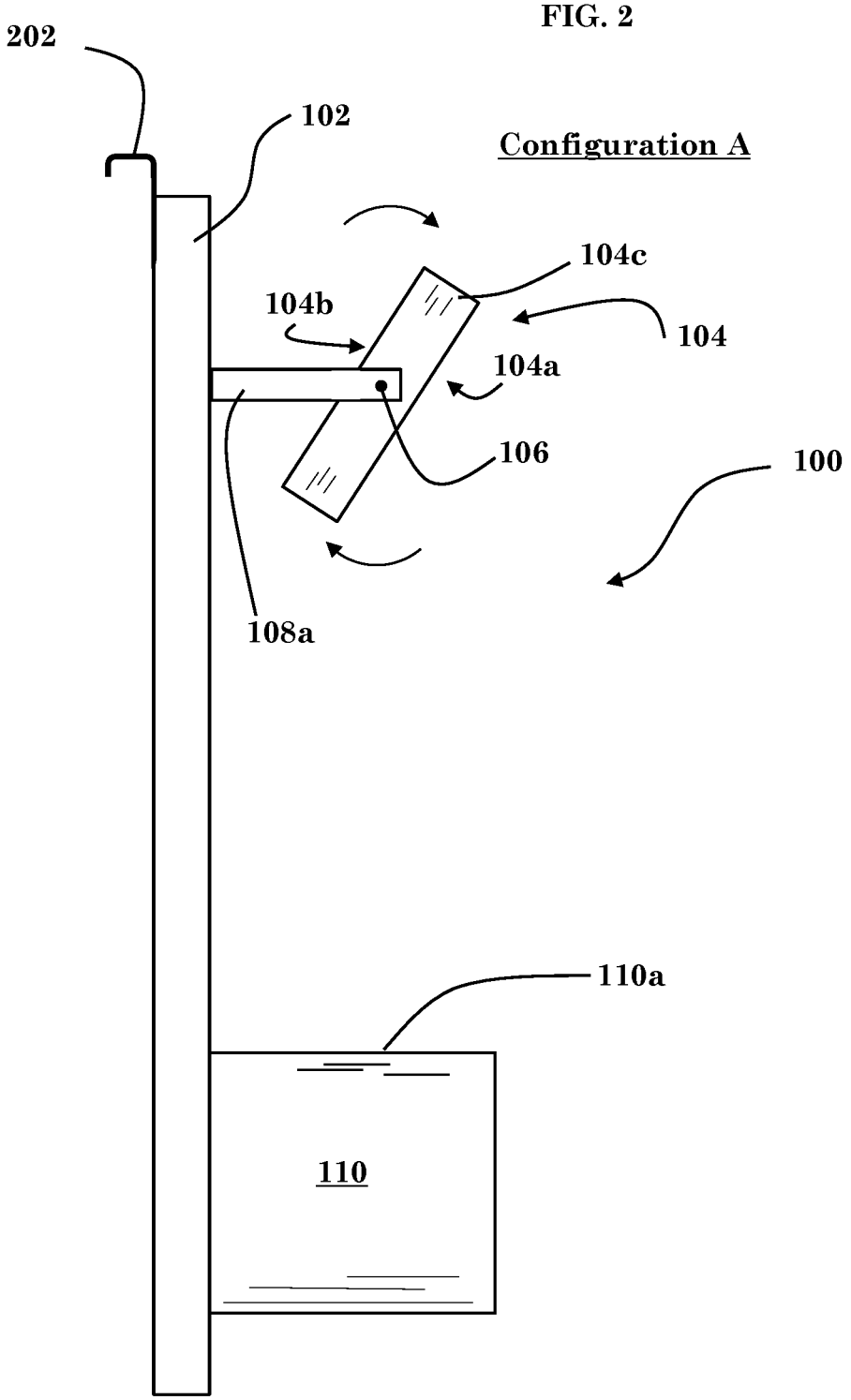
FIG. 2 is a first side view of FIG. 1.

Turning to FIG. 2, the embodiment 100 of FIG. 1 is shown in FIG. 2 from a side view. More specifically, Configuration A is shown from the side. The rotatable disc 104 is shown tilted slightly forward to show its direction of rotation, which is further illustrated by the arrows above and below the rotatable disc 104. Circumferential mounting bracket 108*a* is shown providing sufficient clearance between the rotatable disc 104 and the vertically mountable surface 102 to allow full rotation of the rotatable disc 104. The follow-through landing wedge 110 is shown beneath the rotatable disc 104 with its apex 110*a* directed toward the rotatable disc 104. An example mounting J-bracket 202 is also shown to illustrate how the vertically mountable surface may be mounted. The person having ordinary skill in the art is capable of selecting known mounting brackets, as well as their number and placement, as a matter of design choice. It is contemplated that the embodiment 100 may be mounted to a wall or fence at an end of a dugout so that the pitcher may practice between innings.

Figure 3:
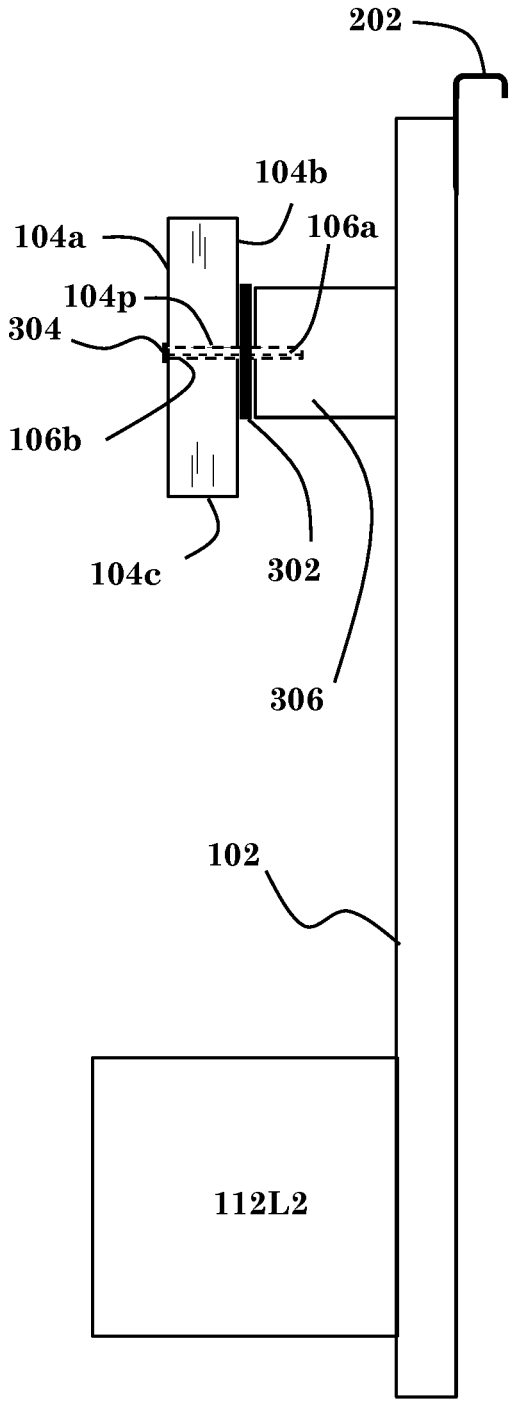
FIG. 3 is a second side view of FIG. 1.

Turning to FIG. 3, the embodiment of FIGS. 1 and 2 is shown from an alternate side view revealing selected structures of Configuration B. particularly, the axle 106 is shown rotatably mounting to the vertically mountable surface 102 through a support bracket 306. More specifically, the first end 106*a* of the axle 106 is shown in an interference fit with the support bracket 306, which in turn is mounted to the vertically mountable base according to known means not shown but discussed elsewhere herein. The axle 106 is thus in a fixed angular relation to the vertically mountable base 102 and is also held stationary by, e.g. the interference fit. The second end 106*b* of the axle receives the rotatable disc 106 through a central aperture 104*p*. The rotatable disc 104 is free to rotate about the axle 106, and is retained on the axle 106 by an end stop 304. The ordinarily skilled artisan will readily understand how to fabricate an end stops 304 without further explanation; however, for example and without limitation, an end stop 304 may be a cap crimped onto the axel, or a flare of the axle in the nature of a nail head. Optionally, a washer 302 may be interposed between the rotatable disc 104 and support bracket 306. Similarly, a washer may be interposed between the rotatable disc 104 and the end stop 304, though none is shown in the illustrated embodiment.

While Configurations A and B are shown here as integrated into a single embodiment, this is not a limitation of the invention. Embodiments may include either Configuration A or Configuration B, or both without departing from the scope of the invention.

I claim:

1. A pitcher training device, comprising:

a vertically mountable surface;

a rotatable disc, having a first circular face and a parallel second circular face separated by a circumferential surface, wherein an axis of rotation of the rotatable disc is in a fixed angular orientation relative to the vertically mountable surface, and the rotatable disc is rotatably mounted to the vertically mountable surface;

a central aperture extending through the circumferential surface at opposing ends and receiving an axle therethrough, wherein the axle fixedly cooperates with the vertically mountable surface while leaving the rotatable disc free to rotate about the axle; and a follow-through landing wedge fixedly mounted to the vertically mountable surface with a landing apex of the follow-through landing wedge oriented toward a center of the rotatable disc.

2. The pitcher training device of claim 1, wherein a first end of the axle is fixedly mounted to the vertically mountable surface through a first circumferential mounting bracket, and a second end of the axle is mounted to the vertically mountable surface through a second circumferential mounting bracket.

3. The pitcher training device of claim 1, wherein a support bracket is interposed between the vertically mountable surface and the axel such that the bracket is affixed to the vertically mountable surface at one end and fixedly receives the axle at an opposing end.

4. A pitcher training device, comprising:

a vertically mountable surface;

a rotatable disc, having a first circular face and a parallel second circular face separated by a circumferential surface, wherein an axis of rotation of the rotatable disc is in a fixed angular orientation relative to the vertically mountable surface, and the rotatable disc is rotatably mounted to the vertically mountable surface;

a central aperture extending through the circumferential surface at opposing ends;

an axle received by the central aperture, wherein the axle fixedly cooperates with the vertically mountable surface while leaving the rotatable disc free to rotate about the axle, wherein a first end of the axle is fixedly mounted to the vertically mountable surface through a first circumferential mounting bracket, and a second end of the axle is mounted to the vertically mountable surface through a second circumferential mounting bracket; and a follow-through landing wedge fixedly mounted to the vertically mountable surface with a landing apex of the follow-through landing wedge oriented toward a center of the rotatable disc.

5. A pitcher training device, comprising:

a vertically mountable surface;

a rotatable disc, having a first circular face and a parallel second circular face separated by a circumferential surface, wherein an axis of rotation of the rotatable disc is in a fixed angular orientation relative to the vertically mountable surface, and the rotatable disc is rotatably mounted to the vertically mountable surface;

a central aperture extending through the first circular face and the second circular face and receiving an axle therethrough, wherein a first end of the axle fixedly cooperates with the vertically mountable surface while leaving the rotatable disc free to rotate about the axle; and a follow-through landing fixedly mounted to the vertically mountable surface with a surface of the follow-through landing oriented toward a center of the rotatable disc.

* * * * *